US007921904B2

(12) United States Patent
Matter et al.

(10) Patent No.: US 7,921,904 B2
(45) Date of Patent: Apr. 12, 2011

(54) HEAT EXCHANGER AND METHOD

(75) Inventors: Jerome A. Matter, Racine, WI (US); Gregory T. Kohler, Waterford, WI (US); Edward A. Robinson, Caledonia, WI (US); Mark W. Johnson, South Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 1105 days.

(21) Appl. No.: 11/656,653

(22) Filed: Jan. 23, 2007

(65) Prior Publication Data

US 2008/0173434 A1 Jul. 24, 2008

(51) Int. Cl.
*F28D 1/047* (2006.01)

(52) U.S. Cl. ..... 165/150; 165/176

(58) Field of Classification Search ..... 165/150, 165/176

See application file for complete search history.

(56) References Cited

U.S. PATENT DOCUMENTS

| | | | | | |
|---|---|---|---|---|---|
| 4,688,311 | A | | 8/1987 | Saperstein et al. | |
| 4,825,941 | A | | 5/1989 | Hoshino et al. | |
| 4,998,580 | A | | 3/1991 | Guntly et al. | |
| 5,267,610 | A | * | 12/1993 | Culbert | 165/151 |
| 5,279,360 | A | * | 1/1994 | Hughes et al. | 165/111 |
| 5,314,013 | A | * | 5/1994 | Tanabe | 165/176 |
| 5,341,870 | A | | 8/1994 | Hughes et al. | |
| 5,372,188 | A | | 12/1994 | Dudley et al. | |
| 5,531,268 | A | * | 7/1996 | Hoshino et al. | 165/153 |
| 5,533,259 | A | | 7/1996 | Hughes et al. | |
| 5,954,125 | A | * | 9/1999 | Mantegazza et al. | 165/149 |
| 6,546,999 | B1 | * | 4/2003 | Dienhart et al. | 165/150 |
| 6,590,770 | B1 | | 7/2003 | Rogers et al. | |
| 6,827,139 | B2 | * | 12/2004 | Kawakubo et al. | 165/173 |
| 6,964,296 | B2 | | 11/2005 | Memory et al. | |
| 7,028,764 | B2 | * | 4/2006 | Reagen | 165/150 |
| 7,104,314 | B2 | * | 9/2006 | Valensa et al. | 165/164 |
| 7,156,163 | B2 | * | 1/2007 | Heng-I et al. | 165/151 |
| 7,503,382 | B2 | * | 3/2009 | Maezawa et al. | 165/144 |
| 2003/0102113 | A1 | | 6/2003 | Memory et al. | |
| 2003/0183378 | A1 | * | 10/2003 | Memory et al. | 165/153 |
| 2004/0003915 | A1 | * | 1/2004 | Shippy et al. | 165/151 |
| 2008/0011463 | A1 | * | 1/2008 | Timbs et al. | 165/151 |

FOREIGN PATENT DOCUMENTS

| | | |
|---|---|---|
| JP | 58-0217195 | 12/1983 |
| JP | 2001-174083 | 6/2001 |
| JP | 2003-075079 | 3/2003 |

* cited by examiner

*Primary Examiner* — Allen J Flanigan

(74) *Attorney, Agent, or Firm* — Michael Best & Friedrich LLP

(57) ABSTRACT

A heat exchanger including a tube having inlet ends and outlet ends and defining a flow path therebetween. The tube can have a first section and a second section arranged at an angle with respect to the first section. Each of the first section and the second section can include a first subsection and a second subsection arranged at an angle with respect to the first subsection.

29 Claims, 8 Drawing Sheets

HEAT EXCHANGER AND METHOD

FIELD OF THE INVENTION

The present invention relates to heat exchangers and, more particularly, to an evaporator, a method of assembling an evaporator, and a method of operating the evaporator.

SUMMARY

In some embodiments, the present invention provides a heat exchanger including a tube having an inlet end and an outlet end and defining a flow path therebetween. The tube can have a first bend and a second bend defining a first section, a second section oriented at an angle with respect to the first section, and a third section oriented at an angle with respect to the second section.

The present invention also provides a heat exchanger including a tube having an inlet end and an outlet end and defining a flow path therebetween. The tube can have a fold defining a first section and a second section. The second section of the tube can be at least partially nested in the first section of the tube.

In addition, the present invention provides a heat exchanger including a tube having inlet ends and outlet ends and defining a flow path therebetween. The tube can have a first section and a second section arranged at an angle with respect to the first section. Each of the first section and the second section can include a first subsection and a second subsection arranged at an angle with respect to the first subsection.

The present invention also provides a method of forming a heat exchanger including the acts of providing a tube having an inlet end and an outlet end and defining a flow path therebetween, folding the tube such that the tube has a first section and a second section at least partially defined by the fold, and nesting the second section in the first section.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also, it is to be understood that phraseology and terminology used herein with reference to device or element orientation (such as, for example, terms like "central," "upper," "lower," "front," "rear," and the like) are only used to simplify description of the present invention, and do not alone indicate or imply that the device or element referred to must have a particular orientation. In addition, terms such as "first," "second," and "third" are used herein for purposes of description and are not intended to indicate or imply relative importance or significance.

In addition, unless specified or limited otherwise, the terms "section" and "subsection" are used herein to define portions of a heat exchanger tube. Moreover, "section" and "subsection" are not restricted to any specific size or length or any relative size or length. Further, to simplify description of the present invention, the term "subsection" is used herein with reference to portions of a "section". However, each of the "subsections" can also or alternatively be considered to be a "section" of a heat exchanger tube.

Figure 1:
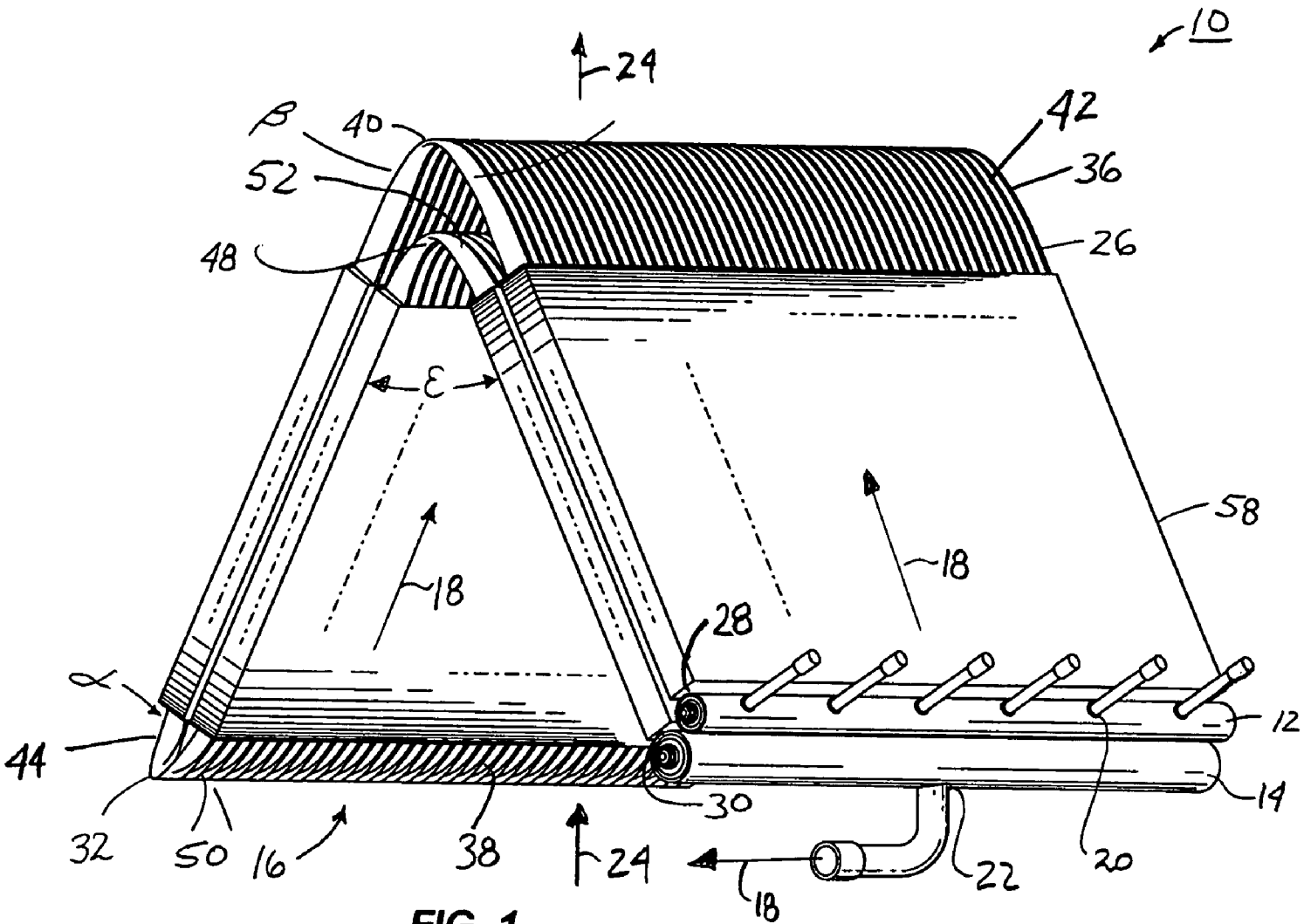
FIG. 1 is a perspective view of a heat exchanger according to some embodiments of the present invention.
Figure 2:
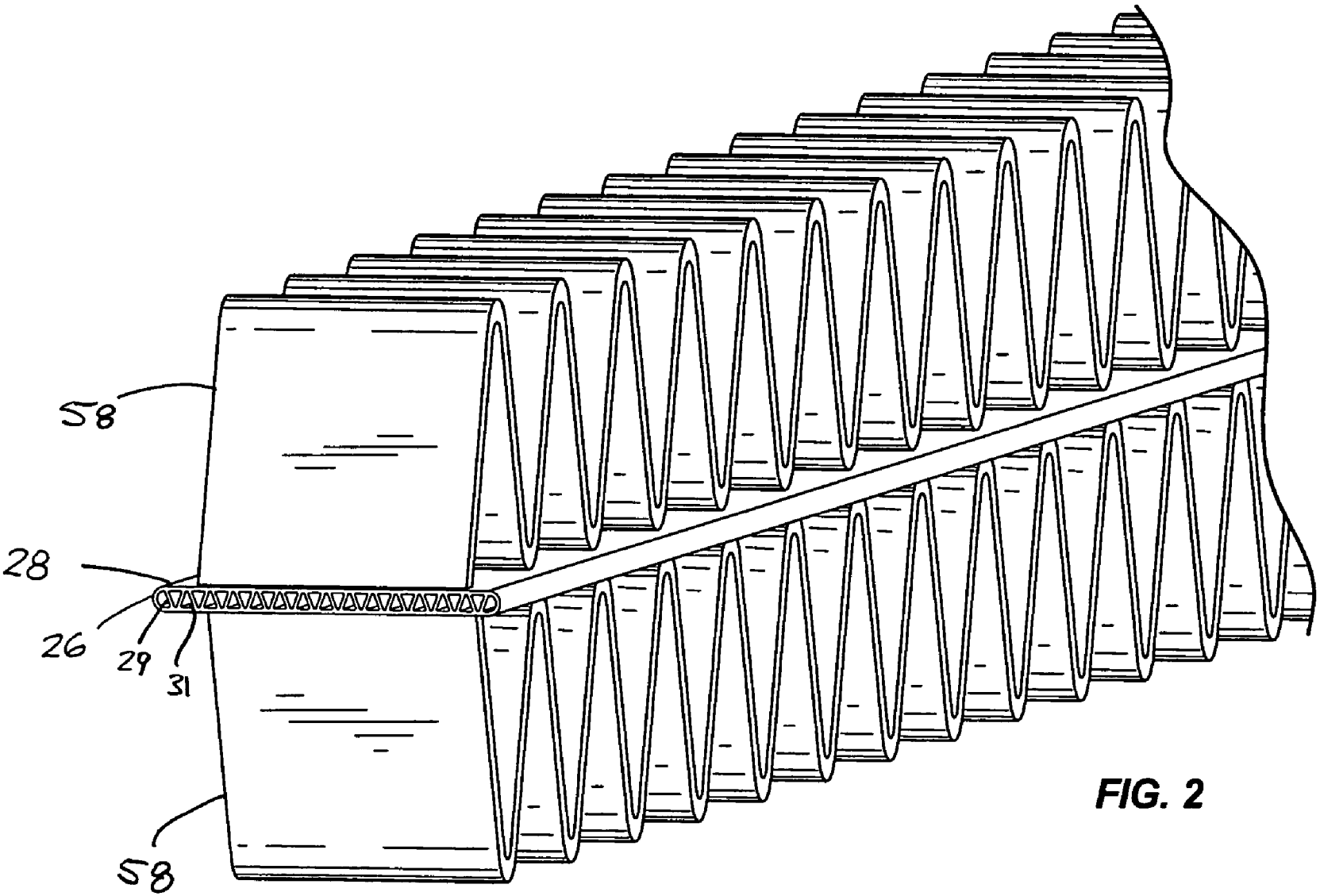
FIG. 2 is an enlarged cross-sectional perspective view of a portion of the heat exchanger shown in FIG. 1.

FIGS. 1 and 2 illustrate a heat exchanger 10 according to some embodiments of the present invention. In some embodiments, including the illustrated embodiment of FIGS. 1 and 2, the heat exchanger 10 can operate as an evaporator and can be used in heating and air-conditioning applications. In other embodiments, the heat exchanger 10 can operate as a condenser. In addition, the heat exchanger 10 can be used in other applications, such as, for example, in electronics cooling, industrial equipment, vehicular applications, and the like. In addition, it should be appreciated that the heat exchanger 10 of the present invention can take many forms, utilize a wide range of materials, and can be incorporated into various other systems.

During operation and as explained in greater detail below, the heat exchanger 10 can transfer heat energy from a high temperature first working fluid (e.g., exhaust gas, water, engine coolant, $CO_2$, an organic refrigerant, R22, R410A, air, and the like) to a lower temperature second working fluid (e.g., exhaust gas, water, engine coolant, $CO_2$, an organic refrigerant, R22, R410A, air, and the like). In addition, while reference is made herein to transferring heat energy between two working fluids, in some embodiments of the present invention, the heat exchanger 10 can operate to transfer heat energy between three or more fluids. Alternatively or in addition, the heat exchanger 10 can operate as a recuperator and can transfer heat energy from a high temperature location of a heating circuit to a low temperature location of the same heating circuit. In some such embodiments, the heat exchanger 10 can transfer heat energy from a working fluid traveling through a first portion of the heat transfer circuit to the same working fluid traveling through a second portion of the heat transfer circuit.

As shown in FIG. 1, the heat exchanger 10 can include a first header 12, a second header 14, and a heat exchanger core 16 connected to the first and second headers 12, 14 along a flow path 18 for the first working fluid. In the illustrated embodiment of FIGS. 1-5, the first header 14 includes inlet openings 20 positioned along a length of the first header 12 and the second header 14 includes a single outlet opening 22. In other embodiments, each of the first and second headers 12, 14 can have one, two, or more openings having the same or different relative orientations and locations. In other embodiments, the heat exchanger 10 can include a single header located at one end of the core 16 or at another location on the heat exchanger 10.

Figure 1A:
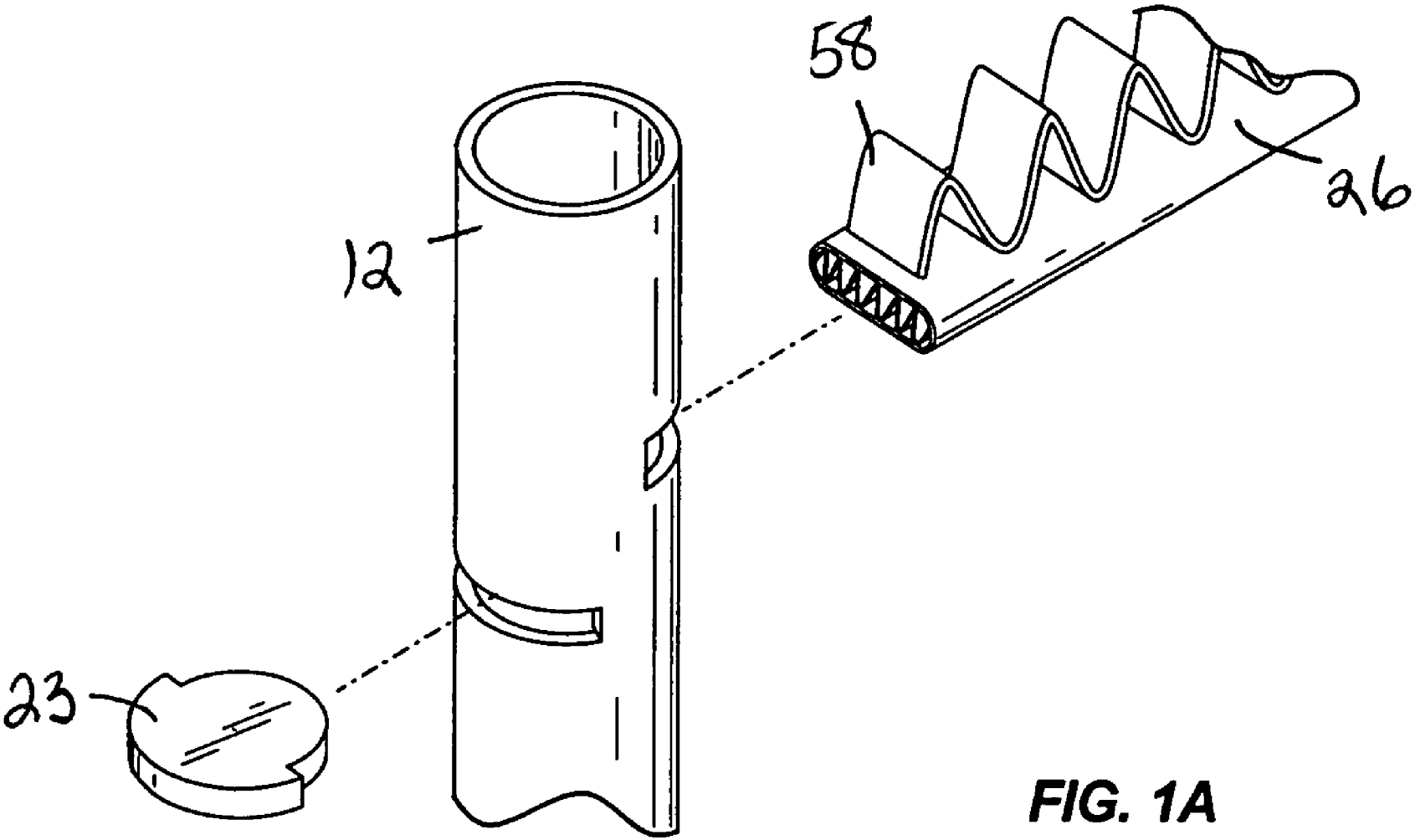
FIG. 1A is an exploded perspective view of a portion of the heat exchanger shown in FIG. 1.

As shown in FIG. 1A, the first header 12 can include a partition 23 located along its length to at least partially separate first and second portions of an interior chamber of the first header 12. Although not shown, the second header 14 can also or alternatively include one or more partitions 23 located along its length.

In embodiments, such as those illustrated in FIGS. 1-2, in which a partition 23 is supported in one or both of the first and second headers 12, 14, the partition 23 can alter or at least partially alter the flow path of the first working fluid through the heat exchanger core 16 such that the first working fluid flows out of the first header 12 from one side of the partition 23, into a first portion of the heat exchanger core 16, into the second header 14, back through a second portion of the heat exchanger core 16, and into the first header 12 on a second side of the partition 23.

A second working fluid (e.g., exhaust gas, water, engine coolant, $CO_2$, an organic refrigerant, R22, R410A, air, and the like) can travel across the heat exchanger 10 along a second flow path (represented by arrows 24 in FIG. 1). In the illustrated embodiment of FIGS. 1 and 2, the heat exchanger 10 is configured as a counter-flow heat exchanger such that the second flow path 24 or a portion of the second flow path 24 is non-parallel to the first flow path 18 or a portion of the first flow path 18. More particularly, in the illustrated embodiment of FIGS. 1 and 2, the second flow path 24 extends in an upward direction across a lower surface of the heat exchanger 10, across the core 16, and upwardly away from an upper surface of the heat exchanger 10.

In other embodiments, the second flow path 24 can extend in a downward direction across the upper surface of the heat exchanger 10, across the core 16, and downwardly away from a lower surface of the heat exchanger 10. In still other embodiments, the second flow path 24 can extend across the heat exchanger 10 from a first side (e.g., a front side, a rear side, a left side, or a right side) of the heat exchanger 10 toward a second side (e.g., a front side, a rear side, a left side, or a right side) of the heat exchanger 10. In still other embodiments, the heat exchanger 10 can have other configurations and arrangements, such as, for example, a parallel-flow configuration.

In the illustrated embodiment of FIGS. 1 and 2, the heat exchanger 10 is configured as a multi-pass heat exchanger with the first working fluid traveling along the first flow path 18 in a first pass and a second pass across the second flow path 24. In other embodiments, particularly in embodiments in which the second flow path 24 extends across the core 16 from a left side toward a right side, the heat exchanger 10 can be configured as a multi-path heat exchanger with the first working fluid traveling along the first flow path 18 in first, second, third, and fourth passes across the second flow path 24.

As shown in FIG. 1, the core 16 includes a tube or coil 26 having first and second ends 28, 30 secured to the first and second headers 12, 14, respectively. In the illustrated embodiment of FIGS. 1 and 2, the tube 26 is an elongated flattened tube having a number of internal partitions defining microchannels 31 having substantially triangular cross-sectional shapes. In some embodiments, the heat exchanger 10 includes a single tube 26 extending between the first and second headers 12, 14. In other embodiments, the heat exchanger 10 can include two or more adjacent tubes 26 having first and second ends 28, 30 secured to the first and second headers 12, 14.

In other embodiments, the heat exchanger 10 can include one or more tubes 26, each of which can be cut or machined to shape in any manner, can be extruded, rolled, or pressed, can be manufactured in any combination of such operations, and the like. Alternatively or in addition, in some embodiments, the tube 26 of the present invention can have a triangular, circular, square or other polygonal, oval, or irregular cross-sectional shape, and the tube 26 can be formed with or without internal partitions 29 such that the tube 26 defines a single channel 31 or a number of individual channels 31.

In the illustrated embodiment of FIGS. 1 and 2, the tube 26 is a flattened tube with an integrally formed sinusoidally-shaped insert 29 extending through the tube 26 between the first and second ends 28, 30. As shown in FIG. 2, crests of the insert 29 are in contact with the interior surface of the tube 26. In some embodiments, the crests of the insert 29 are secured (e.g., brazed, soldered, welded, secured with adhesive or cohesive bonding material, by an interference fit, etc.) to the interior surface of the tube 26.

In embodiments, such as the illustrated embodiment of FIGS. 1 and 2, in which the crests of the insert 29 are secured to the interior surface of the tube 26, the insert 29 at least partially defines a number of discrete parallel flow paths which extend through the tube 26 between the first and second ends 28, 30 of the tube 26. In some such embodiments, the flow paths are capillary flow paths and have a hydraulic diameter of between about 0.015 inches and about 0.070 inches. Hydraulic diameter is defined herein as the cross-sectional area of the flow paths multiplied by four and in turn divided by the wetted perimeter of the corresponding flow path.

As also shown in FIG. 1, the tube 26 includes a first bend 32 positioned to one side of an approximate midpoint between the first and second ends 28, 30. In the illustrated embodiment, the bend 32 is a fold. In other embodiments, the first bend 32 can be positioned at another location along the length of the tube 26 between the first and second ends 28, 30.

In the illustrated embodiment of FIGS. 1 and 2, the first bend 32 at least partially defines a first section 36 and a second section 38 of the tube 26. As shown in FIG. 1, the bend 32 can be formed such that the first section 36 is oriented an acute angle $\alpha$ with respect to the second section 38. In some embodiments, the first section 36 can be oriented at an angle $\alpha$ of between about 10 degrees and about 30 degrees with respect to the second section 38. Alternatively or in addition, the first section 36, or at least a portion of the first section 36, can be substantially parallel to the second section 38.

As shown in FIG. 1, the tube 26 can include a second bend 40 located along the first section 36 of the tube 26. In the illustrated embodiment, the second bend 40 is a fold. The second bend 40 at least partially defines a first subsection 42 and a second subsection 44 of the first section 36. In the illustrated embodiment of FIG. 1, the second bend 40 is positioned at an approximate midpoint of the first section 36 to define first and second subsections 42, 44 of approximately equal lengths. In other embodiments, the second bend 40 can be positioned at another location along the length of the first section 36 such that the first and second subsections 42, 44 have different lengths.

As shown in FIG. 1, the second bend 40 can be formed such that the first subsection 42 is oriented at an angle $\beta$ with respect to the second subsection 44. In some embodiments, the first subsection 42 can be oriented at an angle β of between about 30 degrees and about 120 degrees with respect to the second subsection 44. In other embodiments, the first subsection 42 can be oriented at an angle β of between about 30 degrees and about 80 degrees with respect to the second subsection 44.

As shown in FIG. 1, the tube 26 can include a third bend 48 located along the second section 38 of the tube 26. In the illustrated embodiment, the third bend 48 is a fold. The third bend 48 at least partially defines a first subsection 50 and a second subsection 52 of the second section 38. In the illustrated embodiment of FIG. 1, the third bend 48 is positioned at an approximate midpoint of the second section 38 to define first and second subsections 50, 52 of approximately equal lengths. In other embodiments, the third bend 48 can be positioned at another location along the length of the second section 38 such that the first and second subsections 50, 52 have different lengths.

As shown in FIG. 1, the third bend 48 can be formed such that the first subsection 50 is oriented an acute angle ϵ with respect to the second subsection 44. In some embodiments, the first subsection 50 can be oriented at an angle ϵ of between about 30 degrees and about 80 degrees with respect to the second subsection 52.

In some embodiments, such as the illustrated embodiment of FIGS. 1 and 2, the second section 38 can be at least partially nested in the first section 36 and the first section 36 can be formed around the second section 38 such that the first section 36 at least partially encloses the second section 36. In some such embodiments, the first subsection 42 of the first section 36 can be substantially parallel to the second subsection 52 of the second section 38 along at least a portion of the length of the second subsection 52 of the second section 38. Alternatively or in addition, the second subsection 44 of the first section 36 can be substantially parallel to the first subsection 50 of the second section 38 along at least a portion of the length of the first subsection 50 of the second section 38. In these embodiments, the angle β of the second bend 40 can be substantially equal to the angle ϵ of the third bend 48.

In embodiments, such as the illustrated embodiment of FIGS. 1 and 2, in which the second section 38 is at least partially nested in the first section 36, the second working fluid traveling along the second flow path 24 can be conditioned or at least partially conditioned prior to contacting the first section 36 of the tube 26. In some such embodiments, heat energy is transferred between the first and second working fluids as the second working fluid travels across the second section 38 of the tube 26 such that when the second working fluid contacts the first section 36 of the tube 26, the temperature gradient at the first section 36 of the tube 26 between the first and second working fluids is reduced.

As shown in FIGS. 1 and 2, the heat exchanger 10 can also include one or more fins or contours 58 positioned along the core 16 to improve and/or increase heat transfer between the first and second working fluids traveling through the heat exchanger 10. In the illustrated embodiment of FIGS. 1 and 2, the heat exchanger 10 includes fins 58 positioned along each of the first and second sections 36, 38 of the tube 26 and extending outwardly from the upper and lower sides of the tube 26. In other embodiments, fins 58 can be located on only one side of the core 16 or on only one side of a tube 26, or alternatively, fins 58 can be positioned at regular or irregular intervals along the core 16 or the tube 26. In still other embodiments, the heat exchanger 10 can include plate fins such as those illustrated in FIG. 7 and as described in greater detail below.

In the illustrated embodiment of FIGS. 1 and 2, the fins 58 are formed from corrugated sheets of aluminum, which are secured to the upper and lower sides of the tube 26. In other embodiments, the fins 58 can be integrally formed with the tube 26. In yet other embodiments, the fins 58 can be plate fins. In still other embodiments, the fins 58 and/or the tube 26 can be cast or molded in a desired shape and can be formed from other materials (e.g., copper, iron, and other metals, composite material, and the like).

In embodiments, such as the illustrated embodiment of FIGS. 1 and 2, in which the tube 26 and the fins 58 are separately formed, the fins 58 can be brazed to the tube 26. In other embodiments, the fins 58 can be soldered or welded to the tube 26. In other embodiments, the fins 58 can be secured to the tube 26 with inter-engaging fasteners, other conventional fasteners, adhesive or cohesive bonding material, by an interference fit, etc.

As mentioned above, the tube 26 can include first, second, and third bends 32, 40, 48. The first, second, and third bends 32, 40, 48 can be formed simultaneously or nearly simultaneously, or alternatively the first, second, and third bends 32, 40, 48 can be formed sequentially. In addition, the first, second, and third bends 32, 40, 48 can be formed before or after fins 58 are secured to the tube 26. In some such embodiments, the inclusion of first, second, and third bends 32, 40, 48, and more particularly the inclusion of one or more folds, can allow the heat exchanger 10 to be positioned in a relatively small housing or in a relatively confined location while maximizing heat transfer between the first and second working fluids. In some embodiments, the inclusion of first, second, and third bends 32, 40, 48, and more particularly the inclusion of one or more folds, can allow a heat exchanger 10 which achieves 13 SEER performance requirements to be located in a housing or in a space designed for a comparable heat exchanger which achieves only 10 SEER performance requirements. In some such embodiments, the heat exchanger 10 of the present invention can be used to retrofit or update existing heat exchangers, while improving performance and environmental values.

Figure 3:
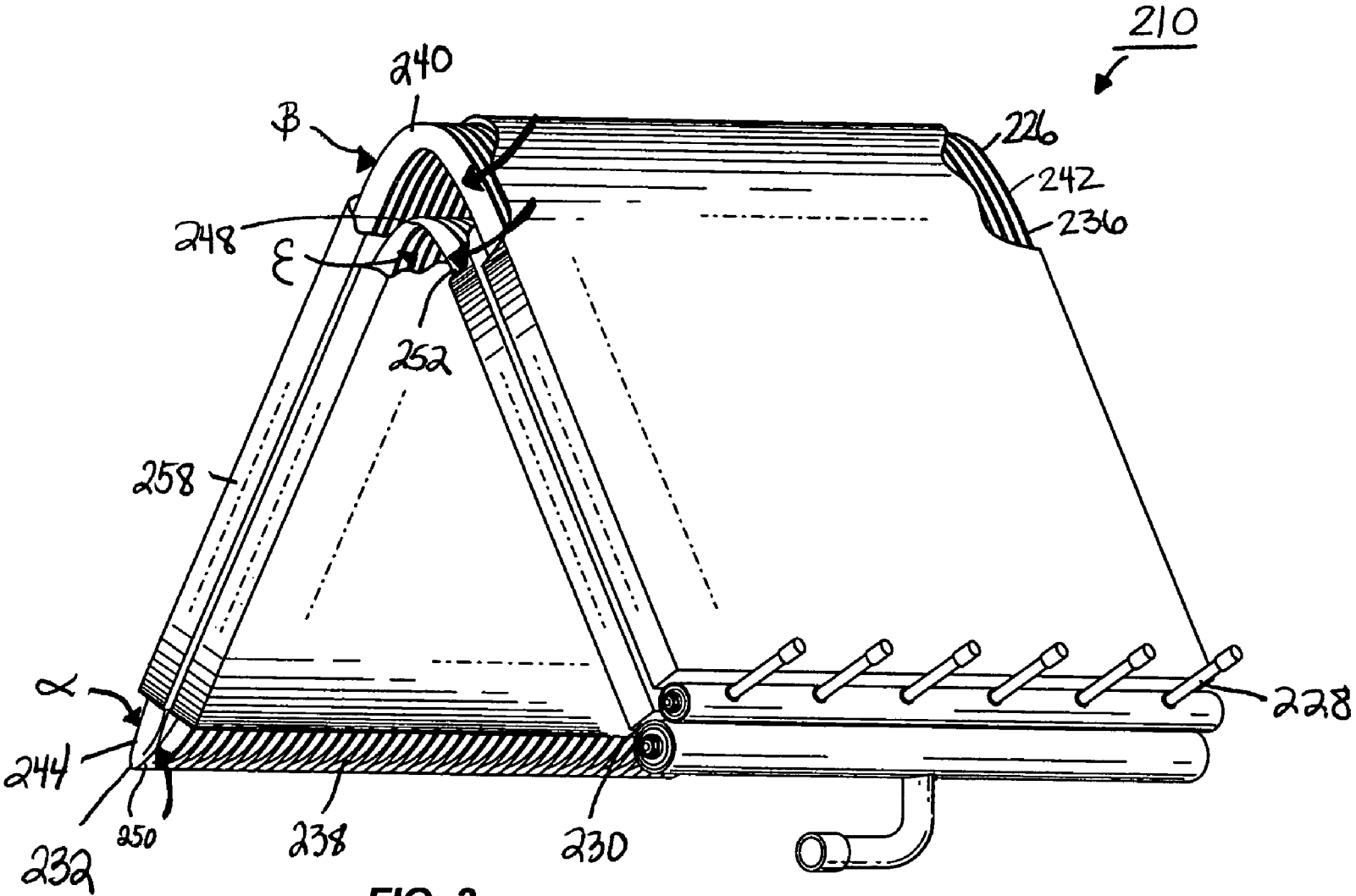
FIG. 3 is a perspective view of a heat exchanger according to another embodiment of the present invention.

FIG. 3 illustrates an alternate embodiment of a heat exchanger 210 according to the present invention. The heat exchanger 210 shown in FIG. 3 is similar in many ways to the illustrated embodiments of FIGS. 1 and 2 described above. Accordingly, with the exception of mutually inconsistent features and elements between the embodiment of FIG. 3 and the embodiments of FIGS. 1 and 2, reference is hereby made to the description above accompanying the embodiments of FIGS. 1 and 2 for a more complete description of the features and elements (and the alternatives to the features and elements) of the embodiment of FIG. 3. Features and elements in the embodiment of FIG. 3 corresponding to features and elements in the embodiments of FIGS. 1 and 2 are numbered in the 200 series.

In the illustrated embodiment of FIG. 3, the heat exchanger 210 includes a tube 226 having a first bend 232 positioned at an approximate midpoint between the first and second ends 228, 230. In the illustrated embodiment, the bend 232 is a fold. In other embodiments, the first bend 232 can be positioned at another location along the length of the tube 226 between the first and second ends 228, 230.

As shown in FIG. 3, the first bend 232 at least partially defines a first section 236 and a second section 238, at least a portion of which can be oriented at an acute angle α with respect to the first section 236. In some embodiments, at least a portion of the first section 236 can be oriented at an angle α of between about 10 degrees and about 30 degrees. Alternatively or in addition, at least a portion of the first section 236 can substantially parallel to the second section 238 along at least a portion of the second section 238.

The tube 226 can also include a second bend 240 positioned at an approximate midpoint of the first section 236 to define first and second subsections 242, 244 of approximately equal lengths. In the illustrated embodiment of FIG. 3, the second bend 240 is not a fold. In other embodiments, the second bend 240 can be positioned at another location along the length of the first section 236 such that the first and second subsections 242, 244 have different lengths. In the illustrated embodiment of FIG. 3, the second bend 240 is not a fold. As shown in FIG. 3, the first subsection 242 can be oriented at an angle β of between about 30 degrees and about 80 degrees with respect to the second subsection 244.

The tube 226 can also include a third bend 248 positioned at an approximate midpoint of the second section 238 to define first and second subsections 250, 252 of approximately equal lengths. In the illustrated embodiment, the third bend 248 is a fold. In other embodiments, the third bend 248 can be positioned at another location along the length of the second section 238 such that the first and second subsections 250, 252 have different lengths. As shown in FIG. 3, the first subsection 250 can be oriented at an acute angle ϵ of between about 30 degrees and about 80 degrees with respect to the second subsection 252.

In some embodiments, such as the illustrated embodiment of FIG. 3, one or more fins 258 can extend across the second bend 240 defined between the first subsection 242 and the second subsection 244 of the first section 236 and across the third bend 248 defined between the first and second subsections 250, 252 of the second section 238. In other embodiments, one or more fins 258 can also or alternatively extend across the first bend 232 between the first and second sections 236, 238 of the tube 226.

Figure 4:
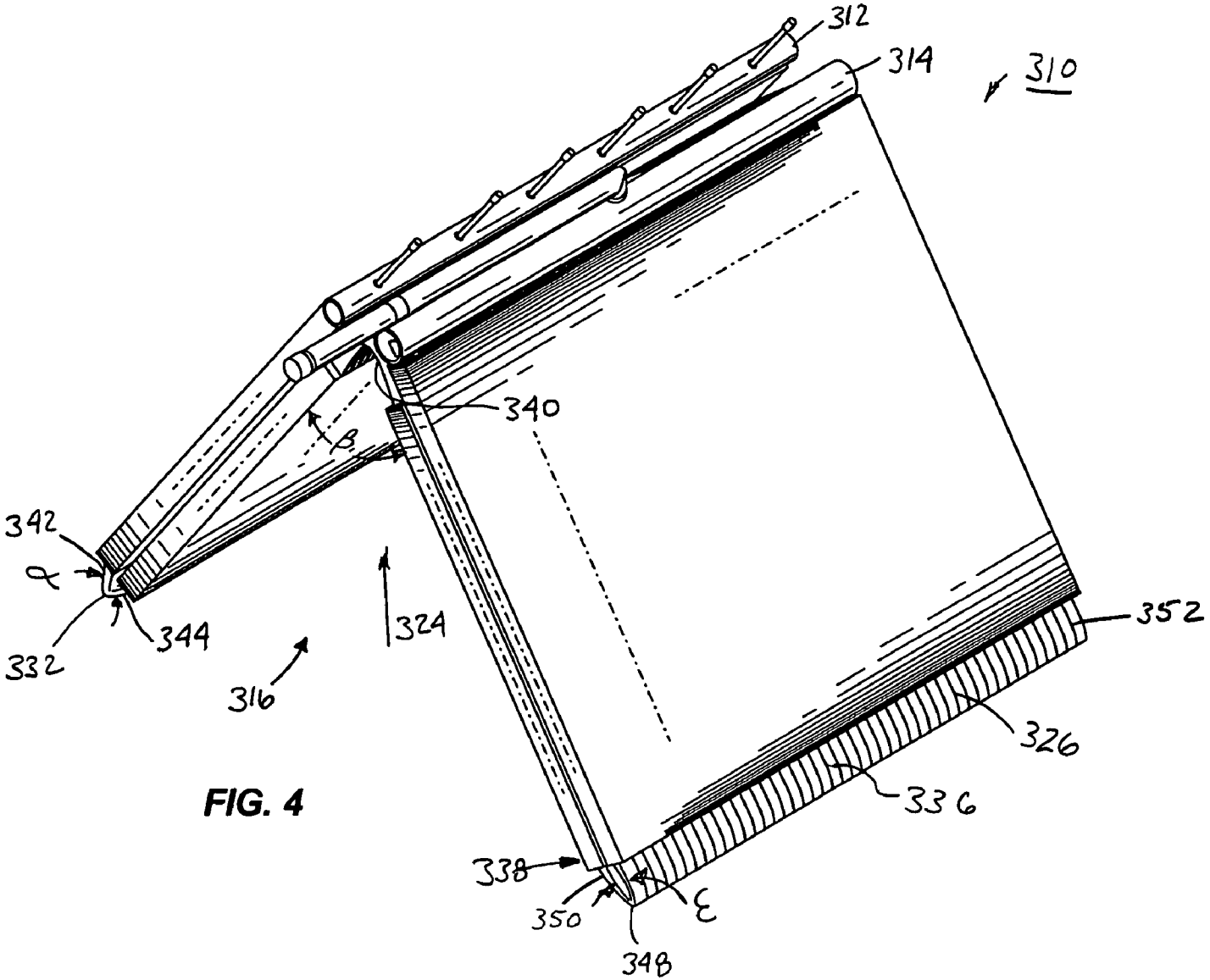
FIG. 4 is a perspective view of a heat exchanger according to yet another embodiment of the present invention.

FIG. 4 illustrates another alternate embodiment of the heat exchanger 310 according to the present invention. The heat exchanger 310 shown in FIG. 4 is similar in many ways to the illustrated embodiments of FIGS. 1-3 described above. Accordingly, with the exception of mutually inconsistent features and elements between the embodiment of FIG. 4 and the embodiments of FIGS. 1-3, reference is hereby made to the description above accompanying the embodiments of FIGS. 1-3 for a more complete description of the features and elements (and the alternatives to the features and elements) of the embodiment of FIG. 4. Features and elements in the embodiment of FIG. 4 corresponding to features and elements in the embodiments of FIGS. 1-3 are numbered in the 300 series.

In the illustrated embodiment of FIG. 4, the heat exchanger 310 includes first and second adjacent headers 312, 314 and a core 316 extending between the first and second headers 312, 314. As shown in FIG. 4, the core 316 can include a tube 326 having first, second, third, and fourth subsections 342, 344, 350, 352. In the illustrated embodiment of FIG. 4, a first bend 332 is located between and at least partially defines the first and second subsection 342, 344. As shown in FIG. 4, the at least a portion of the first subsection 342 is oriented at an acute angle α with respect to the second subsection 344. In some embodiments, the first bend 332 can be a fold and the first subsection 342 can be oriented at an angle α of between about 10 degrees and about 30 degrees with respect to the second subsection 344. Alternatively or in addition, the first subsection 342, or at least a portion of the first subsection 342, can be substantially parallel to the second subsection 344.

In the illustrated embodiment of FIG. 4, a second bend 340 is located between and at least partially defines the second and third subsections 344, 350. As shown in FIG. 4, the second bend 340 can be a fold and the third subsection 344 can be oriented at an acute angle β of between about 30 degrees and about 80 degrees with respect to the third section 350.

In some embodiments, such as the illustrated embodiment of FIG. 4, a third bend 348 is located between and at least partially defines the third and fourth sections 350, 352. As shown in FIG. 4, the third bend 348 can be a fold and at least a portion of the fourth section 352 can be oriented at an acute angle ϵ of between about 10 degrees and about 30 degrees with respect to the fourth section 352. Alternatively or in addition, the third subsection 350 or a portion of the third subsection 350 can be substantially parallel to the fourth subsection 352.

As shown in FIG. 4, the second and third subsections 344, 350 can be nested or at least partially enclosed in the first and fourth subsections 342, 352. In the illustrated embodiment of FIG. 4, the second working fluid travels along the second flow path 324 in an upward direction with respect to the core 316 and contacts the second and third subsections 344, 350 before contacting the first and fourth subsections 342, 352. In this manner, the first and fourth subsections 342, 352 provide a first or upper section 336 of the tube 326 and the second and third subsections 344, 350 provide a second or lower section 338 of the tube 326.

In other embodiments, the second working fluid can travel in a downward direction with respect to the core 316 and can contact the first and fourth subsections 342, 352 before contacting the second and third subsections 344, 350. In still other embodiments, the second working fluid can travel from a left side of the heat exchanger 310 toward a right side of the heat exchanger 210 and can travel along the second travel path 324 sequentially across the first, second, third, and fourth subsections 342, 344, 350, 352, or alternatively, the second working fluid can travel along the second travel path 324 sequentially across the fourth, third, second, and first subsections 352, 350, 344, 342. In yet other embodiments, the second working fluid can travel from a front side of the heat exchanger 310 toward a rear side of the heat exchanger 310.

Figure 5:
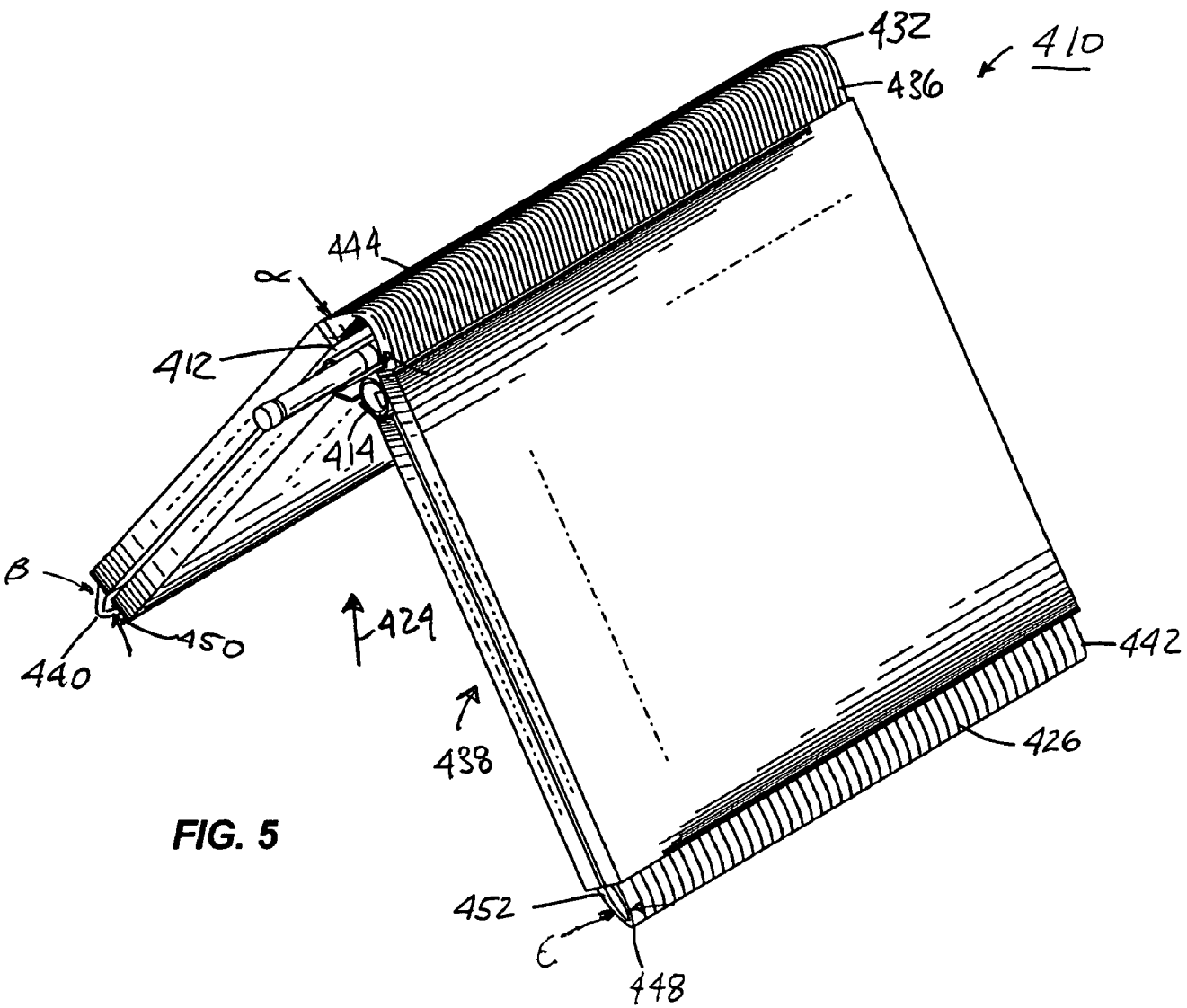
FIG. 5 is a perspective view of a heat exchanger according to still another embodiment of the present invention.

FIG. 5 illustrates an alternate embodiment of the heat exchanger 410 according to the present invention. The heat exchanger 410 shown in FIG. 5 is similar in many ways to the illustrated embodiments of FIGS. 1-4 described above. Accordingly, with the exception of mutually inconsistent features and elements between the embodiment of FIG. 5 and the embodiment of FIGS. 1-4, reference is hereby made to the description above accompanying the embodiments of FIGS. 1-4 for a more complete description of the features and elements (and the alternatives to the features and elements) of the embodiment of FIG. 5. Features and elements in the embodiment of FIG. 5 corresponding to features and elements in the embodiments of FIGS. 1-4 are numbered in the 400 series.

In the illustrated embodiment of FIG. 5, the heat exchanger 410 includes a tube 426 having first, second, third, and fourth subsections 442, 444, 450, 452. In the illustrated embodiment of FIG. 5, a first bend 432 is located between and at least partially defines the first and second subsections 442, 444. As shown in FIG. 5, the first subsection 442 is oriented at an acute angle α with respect to the second subsection 444. In some embodiments, the first subsection 442 can be oriented at an angle α of between about 30 degrees and about 80 degrees with respect to the second subsection 444.

In the illustrated embodiment of FIG. 5, a second bend 440 is located between and at least partially defines the second and third subsections 444, 450. As shown in FIG. 5, the second bend 440 can be a fold and the third subsection 444 can be oriented at an acute angle β of between about 30 degrees and about 80 degrees with respect to the third section 450.

In some embodiments, such as the illustrated embodiment of FIG. 5, a third bend 448 is located between and at least partially defines the third and fourth subsections 450, 452. As shown in FIG. 5, the third bend 448 can be a fold and the fourth section 452 can be substantially parallel to the first subsection 442 or a portion of the first subsection 442. As also shown in FIG. 5, the second subsection 442 can be substantially parallel to the third subsection 450.

As shown in FIG. 5, first and second headers 412, 414 and the third and fourth subsections 450, 452 can be nested or at least partially enclosed in the first and second subsections 442, 444. In the illustrated embodiment of FIG. 5, the second working fluid travels along the second flow path 424 in an upward direction with respect to the core 416 and contacts the third and fourth subsections 450, 452 before contacting the first and second subsections 442, 444. In this manner, the third and fourth subsections 442, 444 provide a first or upper section 436 of the tube 426 and the first and second subsections 442, 444 provide a second or lower section 438 of the tube 426.

Figure 6:
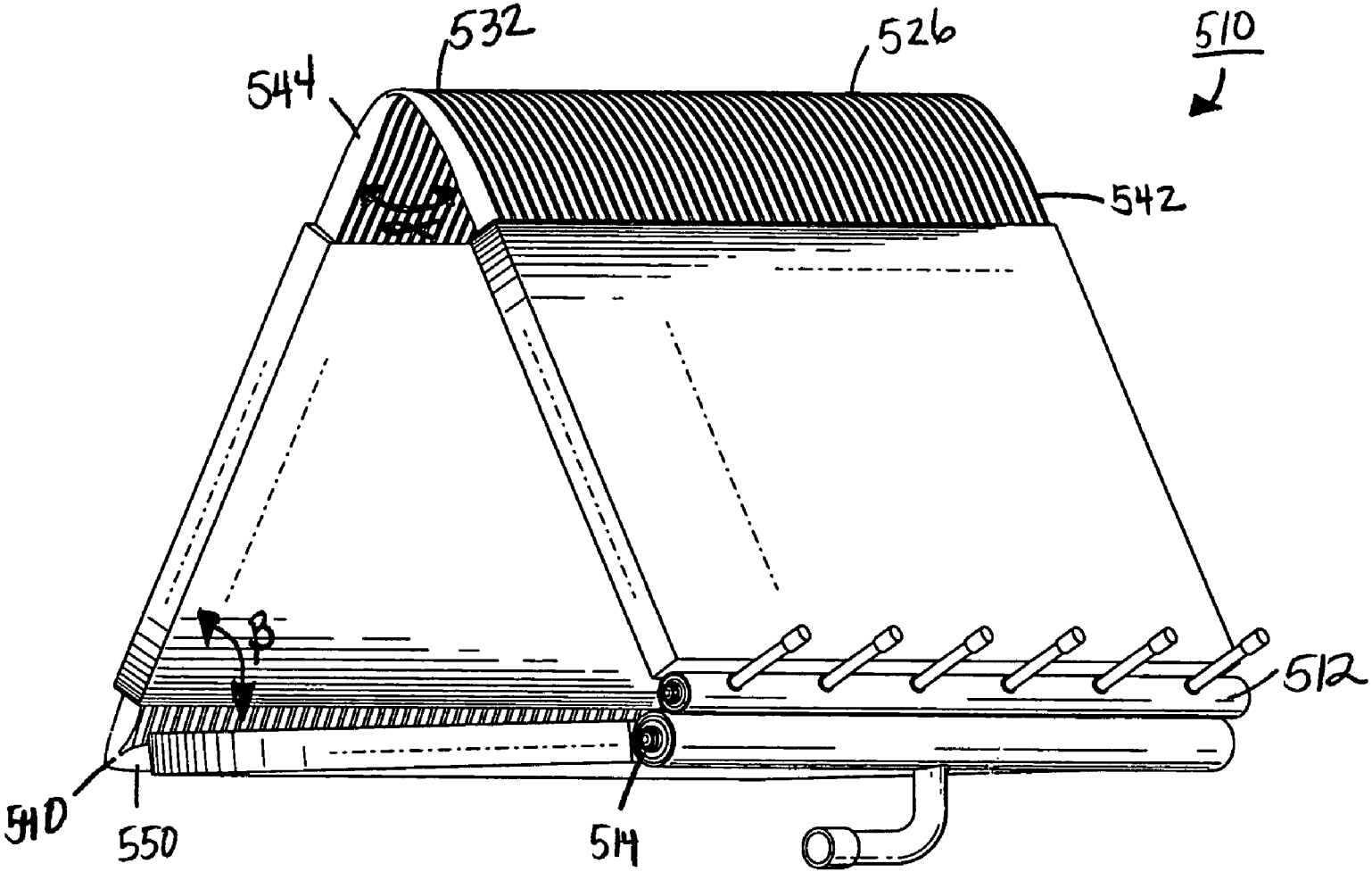
FIG. 6 is a perspective view of a heat exchanger according to yet another embodiment of the present invention.

FIG. 6 illustrates an alternate embodiment of the heat exchanger 510 according to the present invention. The heat exchanger 510 shown in FIG. 6 is similar in many ways to the illustrated embodiments of FIGS. 1-5 described above. Accordingly, with the exception of mutually inconsistent features and elements between the embodiment of FIG. 6 and the embodiment of FIGS. 1-5, reference is hereby made to the description above accompanying the embodiments of FIGS. 1-5 for a more complete description of the features and elements (and the alternatives to the features and elements) of the embodiment of FIG. 6. Features and elements in the embodiment of FIG. 6 corresponding to features and elements in the embodiments of FIGS. 1-5 are numbered in the 500 series.

In the illustrated embodiment of FIG. 6, the heat exchanger 510 includes a tube 526 having first, second, and third subsections 542, 544, 550. In the illustrated embodiment of FIG. 6, a first bend 532 is located between and at least partially defines the first and second subsections 542, 544. As shown in FIG. 6, the first subsection 542 is oriented at an acute angle α with respect to the second subsection 544. In some embodiments, the first subsection 542 can be oriented at an angle α of between about 30 degrees and about 80 degrees with respect to the second subsection 544.

In the illustrated embodiment of FIG. 6, a second bend 540 is located between and at least partially defines the second and third subsections 544, 550. As shown in FIG. 6, the second bend 540 can be a fold and the third subsection 544 can be oriented at an acute angle β of between about 30 degrees and about 80 degrees with respect to the third section 550.

As shown in FIG. 6, the first header 512 can be positioned adjacent to the second header 514, and the first, second, and third subsections 542, 544, 550 of the tube 526 can be substantially similarly sized. In other embodiments, a greater distance can separate the first and second headers 512, 514 and each of the first, second, and third subsections 542, 544, 550 of the tube 526 can be differently sized.

Figure 7:
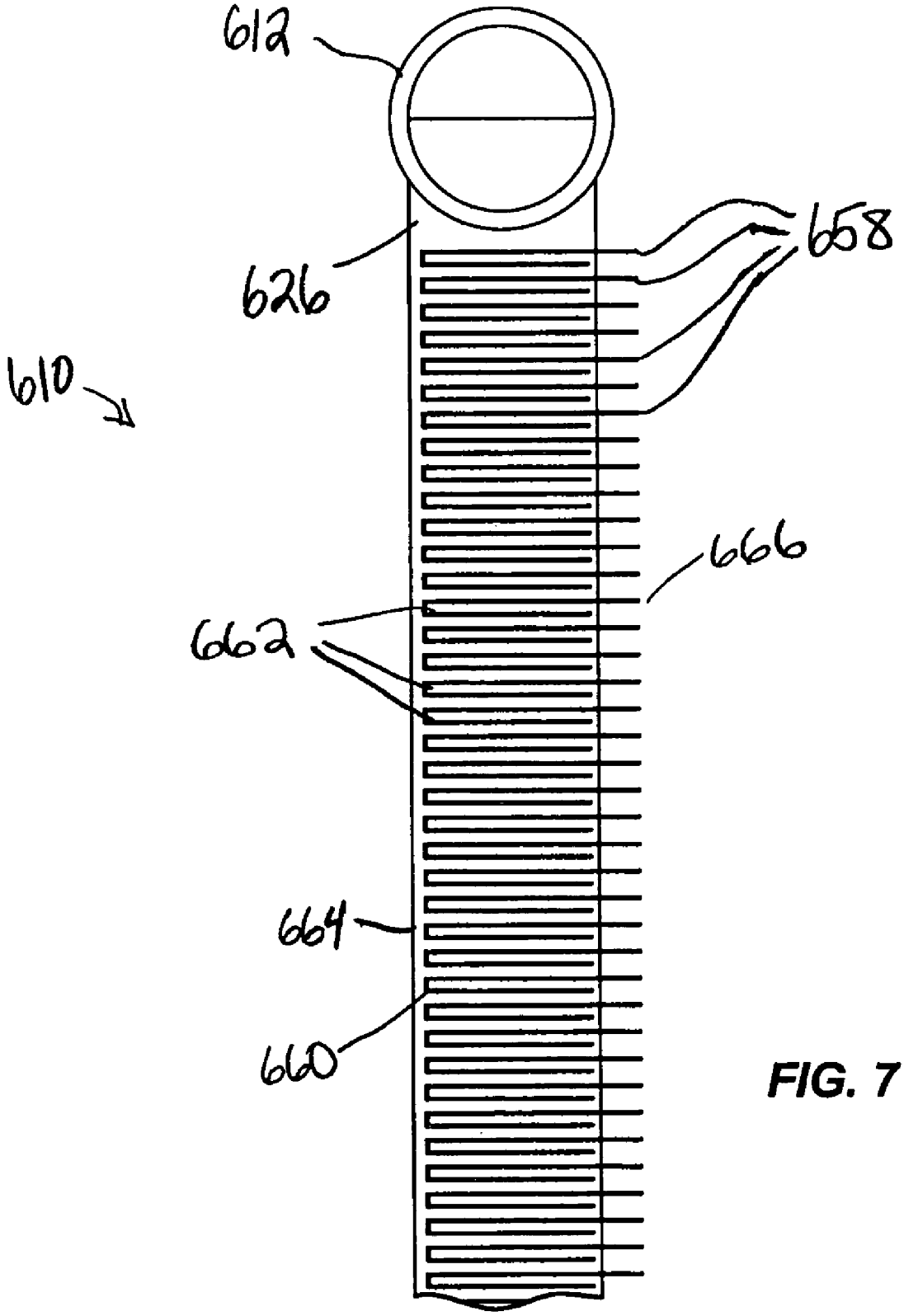
FIG. 7 is a side view of a portion of a heat exchanger according to another embodiment of the present invention.

FIG. 7 illustrates an alternate embodiment of the heat exchanger 610 according to the present invention. The heat exchanger 610 shown in FIG. 7 is similar in many ways to the illustrated embodiments of FIGS. 1-6 described above. Accordingly, with the exception of mutually inconsistent features and elements between the embodiment of FIG. 7 and the embodiment of FIGS. 1-6, reference is hereby made to the description above accompanying the embodiments of FIGS. 1-6 for a more complete description of the features and elements (and the alternatives to the features and elements) of the embodiment of FIG. 7. Features and elements in the embodiment of FIG. 7 corresponding to features and elements in the embodiments of FIGS. 1-6 are numbered in the 600 series.

In the illustrated embodiment of FIG. 7, the heat exchanger 610 includes tubes 626 extending outwardly from at least one header 612 and a series of plate fins 658, which may be formed from aluminum. In other embodiments, one or more of the fins 658 can be made of any rigid or substantially rigid material desired, including without limitation plastic, metal (e.g., steel, titanium, copper, alloys, etc.), composites, or combinations thereof.

As shown in FIG. 7, the fins 658 can be arranged in a stack such that each fin 658 in the stack has a series of slots 660 that open to one elongated edge 662 of the fin 658 in a direction generally normal to the edge 664. An opposite edge 666 of each fin 658 can be uninterrupted or substantially uninterrupted.

In some embodiments, such as the illustrated embodiment of FIG. 7, the heat exchanger 610 can include a number relatively closely packed fins 658. In some such embodiments, the heat exchanger 610 can include between about 15 and about 25 fins 658 per inch. In other embodiments, the heat exchanger 610 can include greater or lesser fin densities.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, while reference is made herein to tubes 26 having a number of bends such that the tubes are substantially A-shaped, in other embodiments, the tubes 26 can include additional bends such that the tubes 26 are substantially N-shaped, W-shaped, or M-shaped. In addition, while the embodiments of the heat exchanger of the present invention are illustrated and described as having a substantially A-shape with one or more peaks extending in a generally upward direction, in other embodiments, the heat exchanger of the present invention can have other relative orientations and configurations such that one or more peaks are oriented to extend in a generally downward direction, in a generally forward direction, in a generally rearward direction, or toward one side.

What is claimed is:

1. A heat exchanger comprising:

a plurality of flattened tubes extending between first and second headers, each tube having an first end connected to the first header and a second end connected to the second header and defining a first flow path therebetween, each tube having a first bend and a second bend defining:

a first section, a second section oriented at an angle with respect to the first section, and a third section oriented at an angle with respect to the second section, the first, second, and third sections being connected in series along the first flow path; and a second flow path that passes over an exterior of the tube, the tube positioned such that the second flow path passes over the first and second sections in parallel and the second flow path passes over the second and third sections in series.

2. The heat exchanger of claim 1, wherein each tube includes at least one fold.

3. The heat exchanger of claim 1, wherein the tube includes a third bend at least partially defining a fourth section, wherein the second flow path passes over the third and fourth sections in parallel and over the fourth and first sections in series.

4. The heat exchanger of claim 3, wherein the fourth section is arranged at an acute angle with respect to the third section.

5. The heat exchanger of claim 3, wherein the third and fourth sections are at least partially nested between the first and second sections.

6. The heat exchanger of claim 3, wherein the angle defined between the first section and the second section is substantially equal to an angle defined between the third section and the fourth section.

7. The heat exchanger of claim 3, wherein the first section is substantially parallel to the third section along at least a portion of a length of the first section.

8. The heat exchanger of claim 7, wherein the second section is substantially parallel to the fourth section along at least a portion of a length of the second section.

9. The heat exchanger of claim 1, wherein the third section is substantially non-parallel to the first section.

10. A heat exchanger comprising:

a flattened tube having an inlet end and outlet end and defining a first flow path therebetween, the tube having a fold defining a first section and a second section in series along the first flow path, the second section of the tube being at least partially nested in the first section of the tube such that a second flow path of fluid flowing around an exterior of the tubes passes the first and second sections in series.

11. The heat exchanger of claim 10, wherein the second section of the tube is substantially parallel to the first section of the tube along at least a portion of a length of the first section of the tube.

12. The heat exchanger of claim 10, wherein the tube includes a second fold.

13. The heat exchanger of claim 10, wherein the first section of the tube includes a bend defining a first subsection and a second subsection.

14. The heat exchanger of claim 13, wherein the second subsection of the first section of the tube is arranged at an angle of between about 30 degrees and about 80 degrees with respect to the first subsection of the first section of the tube.

15. The heat exchanger of claim 13, wherein the second section of the tube includes a bend defining a first subsection and a second subsection.

16. The heat exchanger of claim 15, wherein the second subsection of the first section of the tube is arranged at an angle with respect to the first subsection of the first section of the tube, wherein the second subsection of the second section of the tube is arranged at an angle with respect to the first subsection of the second section of the tube, and wherein the angle defined between the first subsection and the second subsection of the first section is substantially equal to the angle defined between the first subsection and the second subsection of the second section.

17. The heat exchanger of claim 15, wherein the second subsection of the second section of the tube is substantially parallel to the first subsection of the first section of the tube along at least a portion of a length of the second subsection of the second section of the tube, and wherein the first subsection of the second section of the tube is substantially parallel to the second subsection of the first section of the tube along at least a portion of a length of the first subsection of the second section of the tube.

18. A heat exchanger comprising:

a plurality of flattened tubes extending between first and second headers, each tube having a first end connected to the first header and a second end connected to the second header and defining a first flow path therebetween, each tube having:

a first section, and a second section arranged in nesting relationship with the first section, the first section and the second section each including:

a first subsection, and a second subsection arranged at an angle with respect to the first subsection; and a second flow path that passes over an exterior of the tube, the tube positioned such that the second flow path passes over the first and second subsections of each of the first and second sections in parallel and the second flow path passes over the first and second sections in series.

19. The heat exchanger of claim 18, wherein each tube has a fold defining the first section and the second section.

20. The heat exchanger of claim 18, wherein the second section of each tube is substantially parallel to the first section of the tube along at least a portion of a length of the first section of the tube.

21. The heat exchanger of claim 18, wherein each tube includes a fold.

22. The heat exchanger of claim 18, wherein the first section of each tube includes a bend defining the first subsection and the second subsection.

23. The heat exchanger of claim 22, wherein the second section includes a bend defining the first subsection and the second subsection.

24. The heat exchanger of claim 23, wherein the bend of the second section is nested in the bend of the first section.

25. The heat exchanger of claim 18, wherein the first subsection of the first section is oriented at an acute angle with respect to the second subsection of the first section.

26. The heat exchanger of claim 18, wherein the angle defined between the first subsection and the second subsection of the first section is substantially equal to the angle defined between the first subsection and the second subsection of the second section.

27. The heat exchanger of claim 18, wherein the second subsection of the second section is substantially parallel to the first subsection of the first section along at least a portion of a length of the second subsection of the second section of the tube, and wherein the first subsection of the second section of the tube is substantially parallel to the second subsection of the first section along at least a portion of a length of the first subsection of the second section of each tube.

28. The heat exchanger of claim 18, wherein the first section of each tube is formed around the second section of the tube.

29. The heat exchanger of claim 18, wherein the second section of each tube is at least partially nested in the first section of the tube.

* * * * *